United States Patent [19]

Won

[11] Patent Number: 4,551,153

[45] Date of Patent: Nov. 5, 1985

[54] FUEL VAPOR GENERATOR

[76] Inventor: Vann Y. Won, 6697 Gloria Dr., Sacramento, Calif. 95831

[21] Appl. No.: 586,956

[22] Filed: Mar. 7, 1984

[51] Int. Cl.[3] ..... F02M 17/16

[52] U.S. Cl. ..... 48/102 R; 48/180 R; 261/36 A; 261/70; 261/91; 261/DIG. 83; 137/423

[58] Field of Search ..... 261/DIG. 83, 36 A, 70, 261/91; 48/180.1, 102 R; 137/391, 423

[56] References Cited

U.S. PATENT DOCUMENTS

| | | | |
|---|---|---|---|
| 1,137,238 | 4/1915 | Sherman . | |
| 1,504,642 | 8/1924 | Nelson | 261/DIG. 83 |
| 1,622,413 | 3/1927 | Brockway et al. . | |
| 1,847,063 | 2/1932 | Cross | 261/DIG. 83 |
| 1,997,497 | 4/1935 | Pogue | 261/DIG. 83 |
| 2,105,992 | 1/1938 | Tolman | 261/91 |
| 2,201,448 | 5/1940 | Myers | 261/DIG. 83 |
| 2,229,452 | 1/1941 | Hammer et al. | 261/DIG. 83 |
| 3,227,427 | 1/1966 | Wells et al. | 261/DIG. 83 |
| 3,278,174 | 10/1966 | Wahnish | 261/91 |
| 3,325,152 | 6/1967 | Wahnish | 261/46 |
| 3,659,957 | 5/1972 | Yuen | 416/179 |
| 4,267,802 | 5/1981 | Garretson | 261/DIG. 83 |
| 4,270,506 | 6/1981 | Lowe | 261/DIG. 83 |
| 4,368,163 | 1/1983 | Covey, Jr. | 261/DIG. 83 |
| 4,426,984 | 1/1984 | Gilbert | 48/180.1 |
| 4,430,095 | 2/1984 | Gilbert | 48/180.1 |

FOREIGN PATENT DOCUMENTS

| | | | |
|---|---|---|---|
| 2042076 | 9/1980 | United Kingdom | 261/DIG. 83 |

*Primary Examiner*—Tim Miles

*Attorney, Agent, or Firm*—Donald J. Singer; Jacob N. Erlich

[57] ABSTRACT

A fuel vapor generator capable of being incorporated within a carburetor having a housing defining a chamber at the bottom thereof. An input line is attached to the lower portion of the housing for introducing a liquid fuel into the chamber and a return line is also attached to the lower portion of the housing for removing any excess liquid from the chamber and returning the excess liquid to the chamber. Located within the chamber is a level regulating system which, by being operably connected to both the inlet and removal lines is capable of regulating the liquid level within the chamber. In addition, an atomizer is located within the chamber in order to spray the liquid fuel in mist form into the upper portion of the housing for vaporization thereof prior to introduction into the Venturi tube of a carburetor.

18 Claims, 5 Drawing Figures

FIG. 1
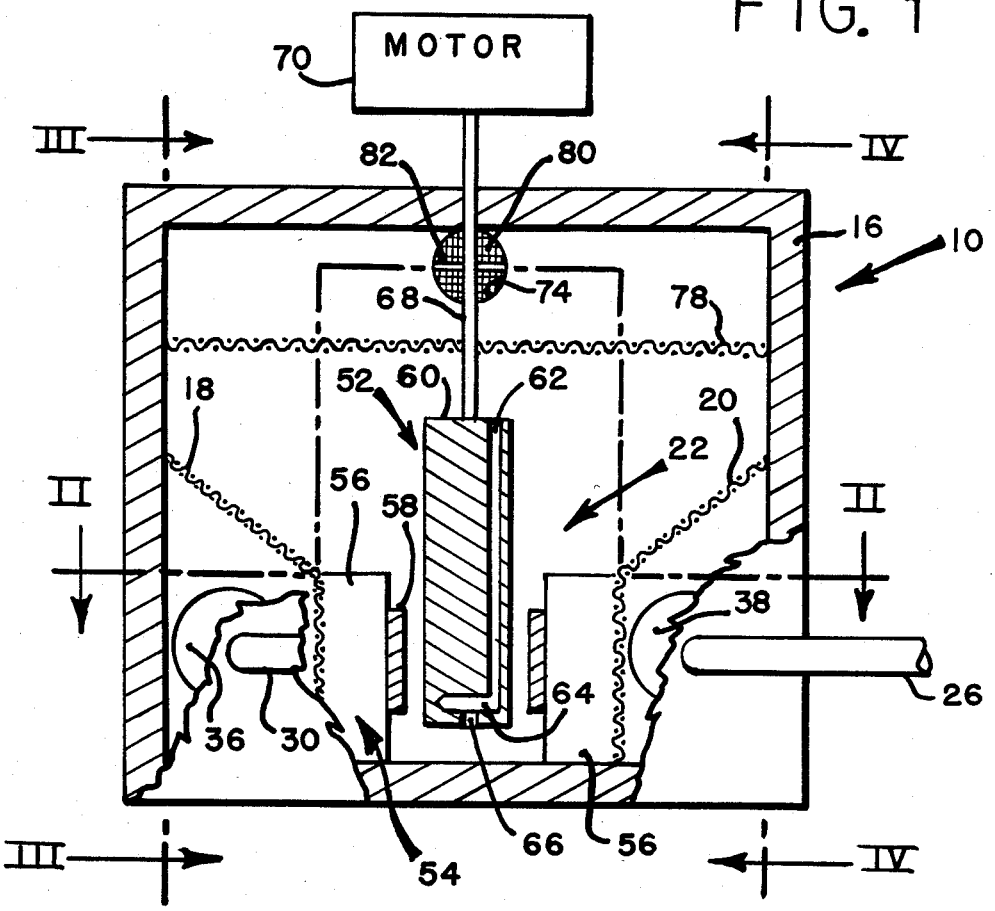
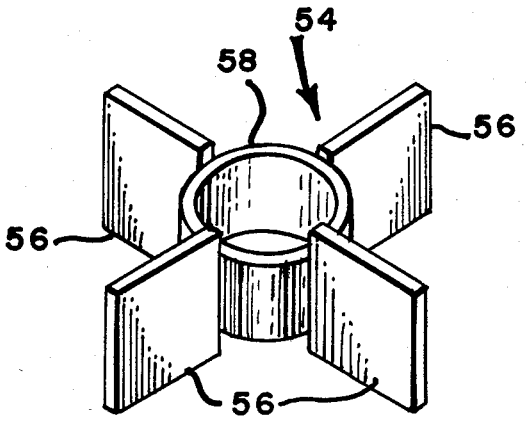
FIG. 5

FIG. 3
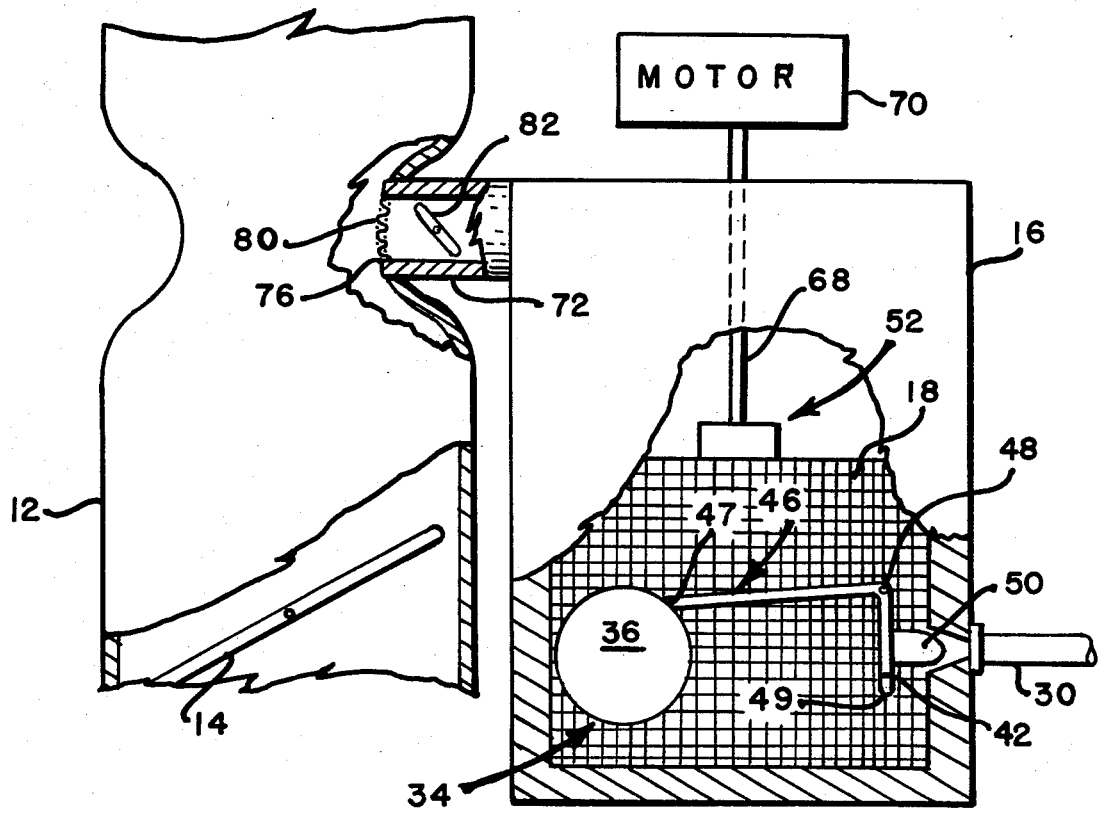
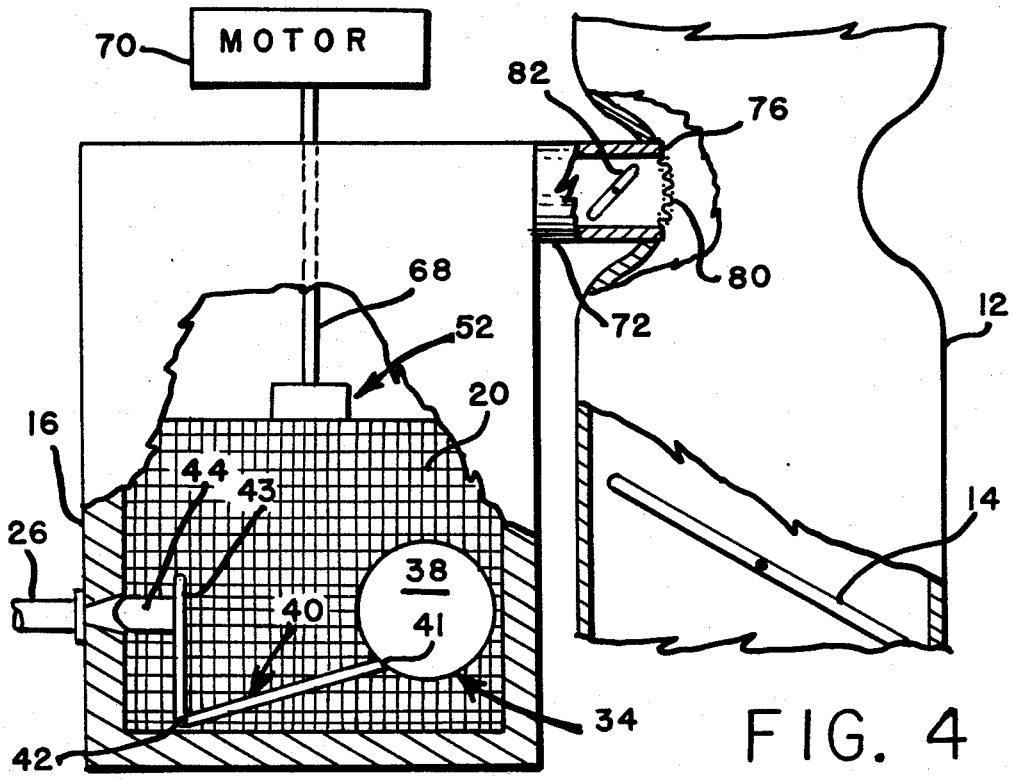
FIG. 4

FUEL VAPOR GENERATOR

STATEMENT OF GOVERNMENT INTEREST

The invention described herein may be manufactured and used by or for the Government for governmental purposes without the payment of any royalty thereon.

BACKGROUND OF THE INVENTION

This invention relates generally to carburetors for internal combustion engines and, more particularly to a fuel vapor generator capable of being incorporated within such carburetors for increasing the efficiency thereof.

The carburetor is a proportioning fuel-air mixing device which can be found in most internal combustion engines. Generally, carburetors include a Venturi tube, more commonly referred to as the choke tube in which the fuel is mixed with a proper proportion of air. Within the Venturi tube of the carburetor air passes through the tube during engine operation while means are connected to the tube for supplying a fine mist of tiny droplets of fuel, such as gasoline, through and into the air stream. With such an arrangement, the droplets of gasoline moving rapidly into the combustion chamber or cylinders of an engine do not ordinarily become completely vaporized even though passed over a heated plate. As a result, somewhat inefficient combustion is obtained because the fuel does not burn completely and some of the unconsumed droplets exit from the engine exhaust as a misty waste. This incomplete fuel evaporation causes poor air to fuel mixing, causing an incomplete combustion to take place with the resultant effect of poor fuel energy efficiency. In addition, a contaminating or polluting stream of gaseous material leaves the engine, thereby constituting a primary cause of the contamination of the atmosphere in regions of high automotive traffic concentration, such as major cities.

There have been many attempts in the prior art to overcome this problem of incomplete combustion. Examples of two such attempts can be found in U.S. Pat. Nos. No. 3,278,174 and 3,325,152 both issued to G. I. Wahnish. In the above-mentioned U.S. Patents, an attempt was made to completely vaporize the incoming fuel prior to entering the Venturi or choke tube. Unfortunately, the type of arrangements described in the above-mentioned patents, although providing for better fuel to air mixing ratio than in the past, still have drawbacks associated therewith For example, the type of arrangement set forth in U.S. Pat. No. 3,278,174 provides for an atomization device which also has a portion thereof directly incorporated within the Venturi tube and which includes a vaporization mechanism which still renders less than total fuel vaporization outside the Venturi tube. With respect to U.S. Pat. No. 3,325,152, this patent introduces a secondary stream of air into the vaporization chamber and consequently may lead to safety problems.

It is therefore generally recognized in the field that it would be highly desirable to improve upon the efficiency of the carburetor of an internal combustion engine by providing totally vaporized fuel into the Venturi or choke tube thereof.

SUMMARY OF THE INVENTION

The present invention overcomes the problems encountered in the past and as set forth in detail hereinabove by providing a fuel vapor generator which is capable of being readily incorporated within a carburetor and which is totally self-contained and capable of efficiently vaporizing fuel prior to its introduction into the Venturi or choke tube of the carburetor.

The fuel vapor generator of the present invention generates a fuel vapor by a totally independent atomization system free from physical limitations of pressure, temperature, kinetic movement and space; that is, all limitations which were undesirable factors with prior devices. Making up the fuel vapor generator of this invention is a housing which contains therein a chamber into which is introduced a liquid fuel for vaporization. Located within the chamber is a uniquely designed system for maintaining the level of the liquid fuel within the chamber at a preselected level range. In addition, a return line enables any excess fuel to be reintroduced into the chamber for further atomization or vaporization. Situated within the chamber is an atomizer capable of virtually completely atomizing or vaporizing the fuel prior to its exit from the vapor generator. Such an atomizer is preferably of the type described in U.S. Pat. No. 3,659,957, issued on May 2, 1972 to this inventor formerly known as Van Yuen and which is incorporacted herein by reference. Also located within the housing of the fuel vapor generator of this invention is a metal screen which is utilized to prevent the liquid fuel from entering the Venturi or choke tube. In addition, a fireproof flash screen prevents any flash fires from occuring within the generator.

During operation of the fuel vapor generator of the present invention, the fuel is continually fed to the chamber and maintained at a preselected level range therein while the atomizer is rotated by a conventional electric motor so as to propel a fine mist of fuel into the upper portion of the housing. This mist is capable of being vaporized immediately due to the infinitely large surface area presented by the mist. The fuel vapor will fill the housing and be drawn into the Venturi or choke tube connected thereto for appropriate mixing with the passing air. When portions of the vapor are discharged from the housing, more vapor will be generated to sustain the appropriate fuel-air mixing ratio. Thus a large volume of fuel vapor may be generated by a relatively small system. In so doing, the fuel vapor generator of the present invention when incorporated within a carburetor of an internal combustion generator will substantially completely eliminate the incomplete fuel evaporation problems heretofore encounted.

It is therefore an object of this invention to provide a fuel vapor generator which is self-contained and capable of efficiently vaporizing a predetermined amount of liquid fuel.

It is still another object of this invention to provide a fuel vapor generator which is capable of being easily incorporated within the carburetor of an internal combustion engine.

It is a further object of this invention to provide a fuel vapor generator which is capable of reliably maintaining a sufficient supply of liquid fuel therein for vaporization.

It is still a further object of this invention to provide a fuel vapor generator which is completely safe and eliminates the possiblity of flash fires occuring therein.

It is even a further object of this invention to provide a fuel vapor generator which is free from the physical limitations of pressure, temperature, kinetic movement, and space generally associated with past fuel vaporization devices.

It is even another object of this invention to provide a fuel vapor generator which is economical to produce and which utilizes conventional, currently available components that lend themselves to standard mass producing manufacturing techniques.

For a better understanding of the present invention, together with other and further objects thereof, reference is made to the following description, taken in conjunction with the accompanying drawings and its scope will be pointed out in the appended claims.

DETAILED DESCRIPTION OF THE DRAWINGS

FIG. 1 is a side elevational view of the fuel vapor generator of the present invention shown partly in cross section;

FIG. 3 is a cross sectional view of the fuel vapor generator of the present invention taken along lines III—III of FIG. 1 and also showing a portion of the Venturi or choke tube of a carburetor associated therewith;

FIG. 4 is a cross sectional view of the fuel vapor generator of the present invention taken along lines IV—IV of FIG. 1 and also showing a portion of the Venturi or choke tube of a carburetor associated therewith; and FIG. 5 is a pictorial illustration of the baffle utilized within the fuel vapor generator of the present invention.

DETAILED DESCRIPTION OF THE PREFERRED EMBODIMENT

Figure 2:
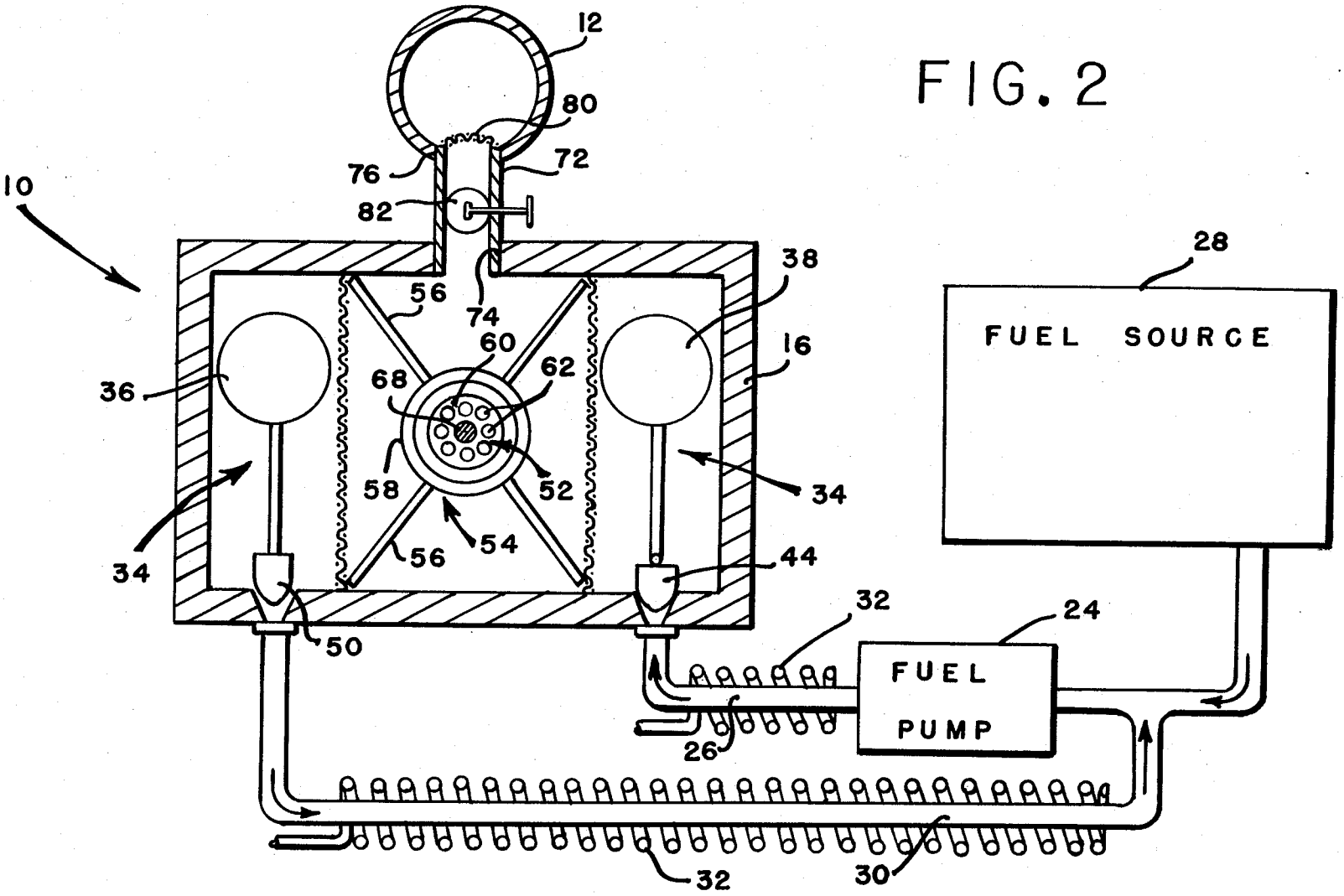
FIG. 2 is a cross sectional view of the fuel vapor generator of the present invention taken along lines II—II of FIG. 1 and also showing a portion of the Venturi or choke tube of a carburetor associated therewith.

The fuel vapor generator 10 of the present invention is a completely self-contained unit which can be incorporated within a carburetor (not shown) of an internal combustion engine by direct connection to the Venturi or choke tube 12 (clearly shown in FIGS. 2 through 4 of the drawings) of such a carburetor. Since the operation of a carburetor is well recognized in the art as pointed out hereinabove, a further detailed description of such a carburetor is not necessary when describing the present invention. It should be pointed out, however, for purposes of better understanding the present invention, that the Venturi or choke tube 12 of the carburetor, which is of conventional design, is equipped at one end thereof with a standard choke valve (not shown) which controls the amount of air flow through choke tube 12 and at the other end thereof with a standard throttle valve 14 which controls the flow of the fuel-air mixture from choke tube 12.

Reference is now made to FIGS. 1 and 2 of the drawings which clearly illustrate the fuel vapor generator 10 of the present invention and its appropriate interconnection with the Venturi or choke tube 12 of a carburetor. As seen in FIG. 1, fuel vapor generator 10 is made up of a housing 16 having defined at the bottom thereof, by means of and including screened walls 18 and 20, a chamber 22 into which is pumped any suitable liquid fuel such as gasoline by any conventional diaphram fuel pump 24 (shown in FIG. 2) through inlet line 26. The liquid fuel, prior to introduction into chamber 22 of vapor generator 10, is stored in any conventional liquid fuel storage tank 28 such as the gasoline tank of an automobile. A return line 30 is also interconnected to chamber 22 through housing 16 in order to remove excess fuel from the chamber 22 and in order to allow reintroduction of the liquid fuel into chamber 22 for vaporization thereof. Any conventional heating jacket 32 may be utilized in conjunction with both inlet line 26 and return line 30 in order to preheat the incoming liquid fuel as an aid in its vaporization within the fuel vapor generator 10 of the present invention.

Controlling the level of liquid fuel within the chamber 22 of fuel vapor generator 10 is a uniquely designed fuel level regulating system 34 more clearly depicted in FIGS. 2 through 4 of the drawings. More specifically, as clearly shown in FIGS. 3 and 4 of the drawings, the fuel level regulating system 34 incorporates therein a pair of floats 36 and 38 which work in a diametrically opposed manner to each other in order to maintain the liquid fuel level within chamber 22 in a range of between $\frac{7}{8}$ inch and 1 inch from the bottom of chamber 22. Float 38 as seen in FIG. 4 of the drawing has an angled or bent arm 40 secured at one end 41 to the bottom of float 38. Arm 40 is pivotally secured to housing 16 by pin 42 and the other end 43 thereof has secured thereto a stopper 44. Stopper 44 is capable of being moved as a result of either an increase or decrease in the level of the liquid fuel within chamber 22 between a position blocking the inlet line 26 when the fuel within chamber 22 reaches a predetermined level of, for example one inch above the bottom of housing 16, and a position unblocking input line 26 when the fluid level within the chamber 22 reaches a level lower than the preselected level.

As seen in FIG. 3 of the drawings, float 36 is depicted therein having an angled or bent arm 46 secured at one end 47 thereof to the top of float 36. Arm 46 is pivotably secured by pin 48 to housing 16 and has a stopper 50 located at the other end 49 thereof capable of blocking return line 30 when the level of the liquid fuel within chamber 22 is below a preselected level of, for example, $\frac{7}{8}$ inch and unblocking return line 30 when the level of the liquid fuel within chamber 22 rises above a preselected level within chamber 22. Consequently, the liquid fuel level within chamber 22 is maintained at all times within a preselected range, of for example between $\frac{7}{8}$ inch and 1 inch, for optimum atomization or vaporization of the fuel by means of atomizer 52 centrally located within chamber 22 in a manner more fully described hereinbelow. As clearly shown in FIGS. 1 and 2 of the drawings, chamber 22 houses a baffle 54 which is clearly shown in FIG. 5 of the drawings, and an atomizer 52. As shown in FIG. 5 of the drawings, baffle 54 is made up of a plurality of outstanding wings or elements 56 which are connected to a centrally located ring 58 having a lesser overhaul height than elements 56. Baffle 54 is placed within the screened walls 18 and 20 of chamber 22 while atomizer 52 is positioned within the central opening of ring 58. Baffle 54 is utilized to substantially eliminate the undesirable whirlpool effect created by the operation of atomizer 52. By the use of baffle 54 liquid is prevented from being forced against and remaining against the sides of housing 16 but allows liquid fuel to continually flow to the center of chamber 22 for introduction into atomizer 52.

Although the fuel vapor generator 10 of the present invention may incorporate therein a number of different types of atomizers, it is essential that these atomizers be capable of extremely efficiently vaporizing the liquid fuel. The preferred atomizer 52 which is utilized with the present invention can be found in U.S. Pat. No. 3, 659,957, issued May 2, 1972 to this inventor formerly known as Vann Yuen and which, as stated above, is incorporated herein by reference. More specifically, atomizer 52 is made up of a cylindrically-shaped body 60 having a plurality of vertically upstanding passageways 62 (one of which being clearly shown in FIG. 1 of the drawings), each passageway 62 being approximately $\frac{1}{8}$ inch in diameter. Passageways 62 open into a chamber 64 and a central opening 66 located at the bottom section of body 60 of atomizer 52. A shaft 68 is utilized to interconnect body 60 to any suitable drive means in the form of, for example, a 7000 rpm AC-DC electric motor 70. A detailed operation of atomizer 52 will be set forth below during the explanation of the operation of the fuel vapor generator 10 of the present invention.

Continuing with the description of the present invention, reference is now made to FIGS. 2 through 4 of the drawing which clearly show tube 72 utilized to interconnect housing 16 of vapor fuel generator 10 to Venturi or choke tube 12. This is accomplished by means of an opening 74 located at the uppermost portion of housing 16 and an opening 76 located in the central portion of Venturi tube 12.

A metal screen 78 is located within the housing 16 adjacent and below opening 74 in order to prevent any of the liquid fuel within chamber 22 from entering the Venturi choke tube 12. In addition, a fire-proof glass screen 80 is located at the end of tube 72 adjacent opening 76 to prevent any flash fires from occurring in the atomization section of generator 10. A valve is pivotally mounted within tube 72 and is utilized to control the amount of fuel vapor entering the Venturi or choke tube 12 at low or idle engine speeds. The adjustment of valve 82 will directly effect the air-fuel ratio. The amount of the fuel vapor will vary with the suction at the Venturi or choke tube opening 76. It is this suction created by the passage of air through the Venturi tube 12 which allows for the fuel vapor to be drawn into tube 12 for mixture with air.

MODE OF OPERATION

Operation of the fuel vapor generator 10 of this invention commences with the introduction of liquid fuel from fuel source 28 through inlet line 26 into chamber 22 of housing 16. Appropriate movement of floats 36 and 38 enable the amount of fuel input and output from chamber 22 to be carefully regulated. For example, optimum results of the present invention are obtained by maintaining a $\frac{7}{8}$ inch to 1 inch fluid level within chamber 22. If the level reaches 1 inch within chamber 22, stopper 44 will close off the inlet line 26. On the other hand, if fuel within chamber 22 exceeds $\frac{7}{8}$ inch, stopper 50 will open return line 30 and allow the excess liquid fuel to flow therethrough, be recirculated, and returned to chamber 22 through input line 26. In this simple and effective manner, the level of liquid fuel within chamber 22 remains substantially constant.

With the appropriate level of liquid fuel within chamber 22, rotation of body 60 of atomizer 52 by electric motor 70 at approximately 1500 RPM or greater causes the liquid fuel within chamber 22 after entering body 60 through the opening 66 at the bottom thereof to be forced upwardly through passageways 62. The liquid leaves passageways 62 of atomizer 52 as a fine globular spray. Such an atomization increases the surface area of the liquid fuel and therefore allows for the substantially instantaneous vaporization of such fuel within the upper portion of housing 16. The vapor is drawn from housing 16 through opening 74 by means of tube 72 and the vacuum created within the Venturi or choke tube 12 of a carburetor. The amount of vapor which passes through tube 72 is regulated by valve 82 located therein.

In some instances, all of the globular spray or mist is not vaporized and in that instance will return to chamber 22 by following the path of the chamber screened walls 18 and 20. It is for that reason that it is necessary to provide a level regulating system 34 within the fuel vapor generator 10 so as to maintain the liquid fuel level within chamber 22 substantially constant. Since substantially complete vaporization of the liquid fuel occurs with the fuel vapor generator 10 of the present invention, its mixture with air through Venturi or choke tube 12 will permit substantially complete combustion to be obtained within the combustion chamber or cylinders of an internal combustion engine. Although this invention has been described with reference to a particular embodiment, it will be understood that this invention is also capable of further and other embodiments within the spirit and scope of the appended claims.

I claim:

1. A vapor generator comprising:

a housing, said housing having a chamber at the bottom thereof, and a screen wall, said screen wall defining and being included as part of said chamber;

means attached to said housing for introducing a liquid into said chamber from a liquid source;

means attached to said housing for permitting the removal of excess liquid from said chamber and for returning sdid excess liquid into said chamber;

means situated within said chamber for regulating the level of said liquid within said chamber, said liquid level regulating means including a pair of floats, each of said floats having an arm pivotally mounted to said housing and connected at one end thereof to said float and the other end thereof having a stopper thereon in communication with said means for introducing liquid into said chamber and said means for permitting the removal of excess liquid from said chamber, respectively, whereby said level of liquid within said chamber may be maintained within a preselected range;

means positioned within said chamber and bounded by a portion of said screen wall for atomizing said liquid, said atomizing means spraying said liquid in mist form into the upper portion of said housing for vaporization thereof; and means located at said upper portion of said housing for permitting said vaporized liquid to be withdrawn from said housing;

wherein any unvaporized liquid falls back into said chamber for further atomization.

2. A vapor generator as defined in claim 1 wherein said upper portion of said housing is otherwise sealed in order to prevent the introduction of air into said housing.

3. A vapor generator as defined in claim 1 further comprising a screen located in the upper portion of said housing interposed between said means for permitting said vaporized liquid to be withdrawn from said housing and said atomizing means.

4. A vapor generator as defined in claim 3 further comprising means located adjacent said atomizing means for allowing said liquid to continually flow to the center of said chamber for introduction into said atomizing means.

5. A vapor generator as defined in claim 4 wherein said means for permitting said vaporized liquid to be withdrawn from said housing comprises an opening in the upper portion of said housing, a tube having one end thereof in communication with said opening, a screen located at the other end of said tube, and means within said tube for regulating the amount of vapor being passed therethrough.

6. A vapor generator as defined in claim 5 further comprising means associated with both said means for introducing a liquid into said chamber and said means for permitting the removal of excess liquid from said chamber for preheating said liquid prior to introduction into said chamber.

7. A vapor generator as defined in claim 6 wherein said atomizing means comprises an elongated, cylindrically-shaped body having a first end and a second end, a liquid receiving chamber formed in a portion of said body adjacent said second end, an opening into said liquid receiving chamber formed in said second end, a plurality of elongated longitudinally extending passageways formed in said body, each of said passageways having an opening positioned adjacent the periphery of said first end, said passageways extending from said first end into said chamber, the longitudinal axis of said passageways being parallel to the longitudinal axis of said body, and means operably connected to the first end of said cylindrically-shaped body for rotating said body at a preselected speed.

8. A vapor generator as defined in claim 7 wherein said means for continually allowing said liquid to flow to the center of said chamber comprises a baffle.

9. A vapor generator as defined in claim 8 wherein said baffle comprises a ring-shaped, centrally located element and a plurality of elements extending therefrom, and said atomizing means being partially contained within said ring-shaped element.

10. A carburetor comprising:

a Venturi tube, said Venturi tube having an opening located therein:

a fuel vapor generator operagbly connected to said Venturi tube for introducing a fuel vapor into said Venturi tube through said opening, said fuel vapor generator including a housing, said housing having a chamber at the bottom thereof, a screen wall, said screen wall defining and being included as part of said chamber; means attached to said housing for introducing a liquid fuel into said chamber from a liquid fuel source; means attached to said housing for permitting removal of excess liquid fuel from said chamber and for returning said excess liquid fuel into said chamber; means situated within said chamber for regulating the level of said liquid fuel within said chamber, said liquid level regulating means including a pair of floats, each of said floats having an arm pivotably mounted to said housing and connected at one end thereof to said float and the other end thereof having a stopper thereon in communication with said means for introducing liquid into said chamber and said means for permitting the removal of excess liquid from said chamber, respectively, whereby said level of liquid within said chamber may be maintained within a preselected range; means positioned within said chamber and bounded by a portion said screen wall for atomizing said liquid fuel thereby spraying said liquid fuel in mist form into the upper portion of said housing for vaporization thereof; means located at said upper portion of said housing for permitting said vaporized liquid fuel to be withdrawn from said housing and fed through said opening into said Venturi tube, said means for permitting said vaporized liquid to be withdrawn including an opening in the upper portion of said housing, a tube having one end thereof in communication with said opening in said housing and the other end thereof in communication with said opening in said Venturi tube, a screen located at the other end of said tube adjacent said opening in said Venturi tube, and means within said tube for regulating the amount of vapor being passed therethrough; and a screen located in the upper portion of said housing interposed between said means for permitting said vaporized liquid to be withdrawn from said housing and said atomizing means; and wherein any unvaporized liquid within the upper portion of said housing falls back into said chamber for further atomization.

11. A carburetor as defined in claim 10 wherein said upper portion of said housing is otherwise sealed in order to prevent the introduction of air into said housing.

12. A carburetor as defined in claim 10 further comprising means located adjacent said atomizing means for allowing said liquid to continually flow to the center of said chamber for introduction into said atomizing means.

13. A carburetor as defined in claim 12 further comprising means associated with both said means for introducing a liquid into said chamber and said means for permitting the removal of excess liquid from said chamber for preheating said liquid prior to introduction into said chamber.

14. A carburetor as defined in claim 13 wherein said atomizing means comprises an elongated, cylindrically shaped-body having a first end and a second end, a liquid receiving chamber formed in a portion of said body adjacent said second end, an opening into said liquid receiving chamber formed in said second end, a plurality of elongated longitudinally extending passageways formed in said body, each of said passageways having an opening positioned adjacent the periphery of said first end, said passageways extending from said first end into said chamber, the longitudinally axis of said passageways being parallel to the longtudinal axis of said body, and means operably connected to said first end of said cylindrically-shaped body for rotating said body at a preselected speed.

15. A carburetor as defined in claim 14 wherein said means for continually allowing said liquid to flow to center of said chamber comprises a baffle.

16. A carburetor as defined in claim 15 wherein said baffle comprises a ring-shaped, centrally located element and a plurality of elements extending therefrom, and said atomizing means being partially contained within said ring-shaped element.

17. A carburetor comprising:

a Venturi tube, said Venturi tube having an opening located therein;

a fuel vapor generator operably connected to said Venturi tube for introducing a fuel vapor into said Venturi tube through said opening, said fuel vapor generator including a housing, said housing having a chamber at the bottom thereof, a screen wall, said screen wall defining and being included as part of said chamber; means attached to said housing for introducing a liquid fuel into said chamber from a liquid fuel source; means attached to said housing for permitting removal of excess liquid fuel from said chamber and for returning said excess liquid fuel into said chamber; means situated within said chamber for regulating the level of said liquid fuel within said chamber, said liquid level regulating means including a pair of floats, each of said floats having an arm pivotably mounted to said housing and connected at one end thereof to said float and the other end thereof having a stopper thereon in communication with said means for introducing liquid into said chamber and said means for permitting the removal of excess liquid from said chamber, respectively, whereby said level of liquid within said chamber may be maintained within a preselected range; means positioned within said chamber and bounded by a portion said screen wall for atomizing said liquid fuel thereby spraying said liquid fuel in mist form into the upper portion of said housing for vaporization thereof; and means located at said upper portion of said housing for permitting said vaporized liquid fuel to be withdrawn from said housing and fed through said opening into said Venturi tube; and whereinany unvaporized liquid within the upper portion of said housing falls back into said chamber for further atomization.

18. A carburetor as defined in claim 17 wherein said upper portion of said housing is otherwise sealed in order to prevent the introduction of air into said housing.

* * * * *